US007677882B2

(12) United States Patent
Harless

(10) Patent No.: US 7,677,882 B2
(45) **Date of Patent: *Mar. 16, 2010**

(54) SMOKELESS LIQUID DUAL-PHASE BURNER SYSTEM

(75) Inventor: Jerome Harless, Laurel, MS (US)

(73) Assignee: Expro Americas, LLC, Houston, TX (US)

( * ) Notice: Subject to any disclaimer, the term of this patent is extended or adjusted under 35 U.S.C. 154(b) by 851 days.

This patent is subject to a terminal disclaimer.

(21) Appl. No.: 11/489,034

(22) Filed: Jul. 19, 2006

(65) Prior Publication Data

US 2007/0231758 A1 Oct. 4, 2007

Related U.S. Application Data

(60) Provisional application No. 60/788,935, filed on Apr. 4, 2006.

(51) Int. Cl.
*F23G 7/08* (2006.01)

(52) U.S. Cl. ..... 431/202; 431/5; 431/244; 110/160

(58) Field of Classification Search ..... 431/289, 431/296, 253, 343, 5, 202, 244; 110/160
See application file for complete search history.

(56) References Cited

U.S. PATENT DOCUMENTS

| | | | | |
|---|---|---|---|---|
| 2,454,365 | A | 11/1948 | Myra | |
| 2,802,521 | A | 8/1957 | Campbell et al. | |
| 3,134,424 | A * | 5/1964 | Zink et al. | 431/202 |
| 3,308,868 | A * | 3/1967 | Reichhelm | 431/41 |
| 3,797,991 | A | 3/1974 | Straitz, III | 431/202 |
| 3,810,733 | A | 5/1974 | Reagan | |
| 3,822,985 | A * | 7/1974 | Straitz, III | 431/284 |
| 3,824,073 | A | 7/1974 | Straitz, III | |
| 3,893,810 | A | 7/1975 | Lientz | |
| 3,914,094 | A | 10/1975 | Landry | |
| 3,994,671 | A | 11/1976 | Straitz, III | 431/202 |
| 4,008,041 | A * | 2/1977 | Roffe et al. | 392/397 |
| 4,227,872 | A | 10/1980 | Zink et al. | 431/90 |
| 4,255,120 | A * | 3/1981 | Straitz, III | 431/202 |
| 4,392,817 | A * | 7/1983 | Berlie et al. | 431/202 |
| 4,419,071 | A | 12/1983 | Schwartz | 431/202 |
| 4,468,193 | A * | 8/1984 | Lawrence et al. | 431/89 |
| 4,643,669 | A | 2/1987 | Bozai | 431/202 |
| 4,664,617 | A | 5/1987 | Schwartz et al. | 431/8 |
| 4,824,361 | A * | 4/1989 | McGill et al. | 431/202 |
| 5,295,817 | A | 3/1994 | Young | 431/11 |
| 5,429,496 | A | 7/1995 | Stephens et al. | |

(Continued)

FOREIGN PATENT DOCUMENTS

| | | |
|---|---|---|
| CA | 2287732 | 4/2001 |

*Primary Examiner*—Kenneth B Rinehart
*Assistant Examiner*—Daniel A Bernstein
(74) *Attorney, Agent, or Firm*—Elizabeth R. Hall

(57) ABSTRACT

The smokeless liquid two-phase burner system of the present invention relates to a method and apparatus for burning a wide variety of flammable liquids using an integrated burner system. The system has both a primary injection path and an alternate injection path for the liquid fuel to be burned, as well as a main air pump or blower. The present invention also provides a method and apparatus for selectably injecting a secondary stream of a gas or vapor or volatile liquid into a flare system for the purpose of enhancing combustion.

17 Claims, 9 Drawing Sheets

U.S. PATENT DOCUMENTS 5,807,095 A 9/1998 Gustafson et al.
5,993,196 A 11/1999 Young et al. ..... 431/202
6,431,855 B1 8/2002 Pedersen
6,638,059 B1 10/2003 Mougey ..... 431/202
6,840,760 B1 1/2005 Keller et al. ..... 431/202
2007/0077528 A1 4/2007 Sheridan

* cited by examiner

FIGURE 4
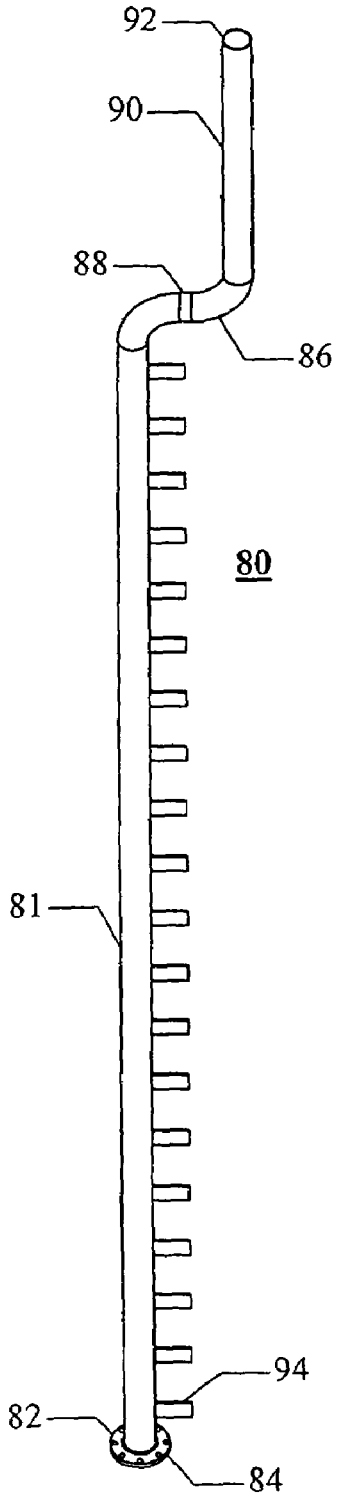
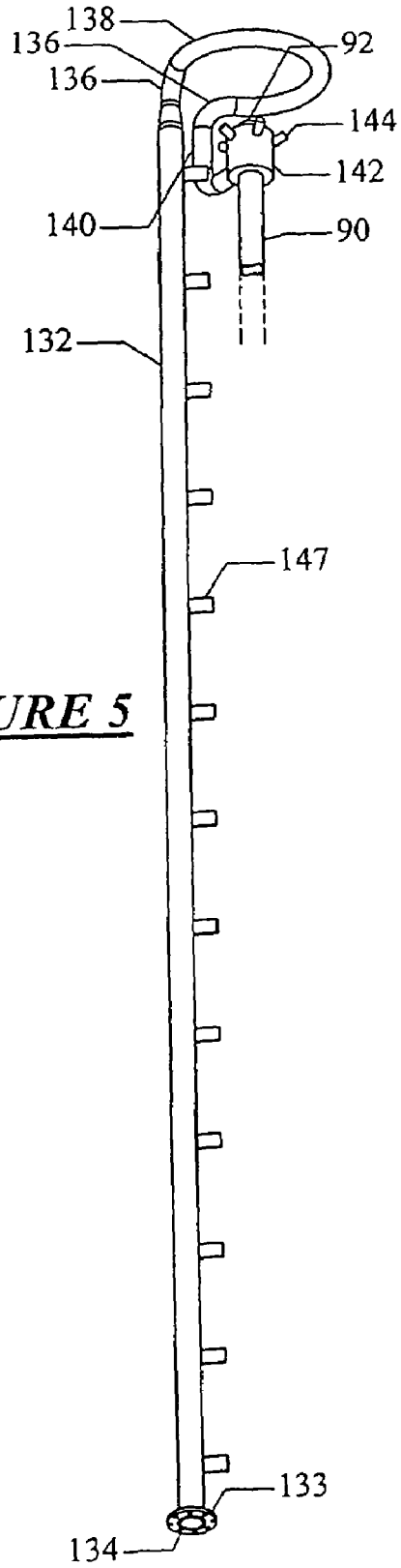
FIGURE 5

150
167
166
161
165
197
164
162
175
195
161
161
161
173
185
192
191
161
161
160
193
194
183
182
180
171
155
170
157
153
152
151
154

10

SMOKELESS LIQUID DUAL-PHASE BURNER SYSTEM

CROSS REFERENCE TO RELATED APPLICATIONS

This application claims priority to U.S. Patent Application Ser. No. 60/788,935, filed Apr. 4, 2006 by Jerome Harless and entitled "Smokeless Liquid Dual-Phase Burner System."

BACKGROUND OF THE INVENTION

1. Field of the Invention

The present invention relates to a method and apparatus that is selectably optimized for burning different classes of waste fuels using an integrated burner system. More particularly, the present invention relates to a method and apparatus for selectably injecting a secondary stream of a gas or vapor into a flare system for the purpose of enhancing combustion of the waste fuel.

2. Description of the Related Art

Flare systems are commonly used to burn waste flammable fluids such as oilfield drilling pit contents, fluids from pipeline depressurization blowdowns, and waste chemical streams. Commonly used flare systems are optimized for a particular class of fluids or even a specific fluid. In order to produce optimal burning so that the flare is both smokeless and complete combustion occurs, previous flare stacks have been provided with a capability of injecting a single type of gaseous phase into the flow stream of liquid being burned, along with the air stream normally fed to the flare to aid combustion. However, these flare stacks generally do not adapt well to a broad spectrum of flammable liquid properties. If a flare stack works well for lighter, more volatile fluids, it typically will be inadequate for a more viscous fluid or a less volatile fluid. If a fluid that has a low heating value is used with a flare system that has been designed for a high heating value fluid, the flare performance generally will be unsatisfactory.

A need exists for a flare system that can be adapted readily to various liquids with wide variations in their characteristic properties. Additionally, a need exists for a flare system that is completely self-contained.

SUMMARY OF THE INVENTION

The present invention relates to a method and apparatus that is selectably optimized for burning different classes of flammable liquids using an integrated burner system. The smokeless liquid two-phase burner system of the present invention can burn a wide variety of flammable liquids using an integrated burner system by selectably injecting a secondary stream of a gas or vapor into a flare system for the purpose of enhancing combustion.

One aspect of the present invention is a flare system for burning waste fuel comprising: (a) a central flare stack member adapted for connection with an air supply at a first end; (b) a plurality of fuel paths for conducting a waste fuel to an outlet at a second end of the central flare stack member; (c) means for igniting the waste fuel positioned proximal the second end of the central flare stack member; and (d) a manifold having a waste fuel inlet end adapted for connection to a waste fuel source, wherein the manifold selectably connects the waste fuel source with one of the fuel paths, and an accelerator fuel inlet end adapted for connection to an accelerator fuel source, wherein the manifold selectably connects the accelerator fuel source to one of the fuel paths.

Another aspect of the present invention is a flare system for burning waste fuel comprising: (a) a vertical tubular flare stack member adapted for connection with an air supply at a first end; (b) means for igniting a waste fuel positioned proximal a second end of the central flare stack member; (c) a manifold having (i) multiple valving members, (ii) a waste fuel inlet end adapted for connection to a waste fuel source, wherein selected manifold valving members selectably connect the waste fuel source with one of the fuel paths, and (iii) an accelerator fuel inlet end adapted for connection to an accelerator fuel source, wherein selected manifold valving members selectably connect the accelerator fuel source to one of the fuel paths; and (d) a plurality of fuel paths for conducting the waste fuel between a second end of the flare stack member and the igniting means, wherein one fuel path permits mixing of the waste fuel with an accelerator fuel.

Yet another aspect of the present invention is a flare burner for burning waste fuel comprising: (a) an elongated vertical flare stack central tube having a main air port proximal to a first end of the flare stack and an auxiliary port; (b) an ignitor positioned above a second end of the flare stack central tube; (c) a plurality of fuel paths for conducting a waste fuel proximal the second end of the central tube, the fuel paths including (i) an open tip fuel supply line, wherein an upper portion of the open tip fuel supply line is coaxial with the vertical axis of the flare stack central tube and an outlet of the open tip fuel supply line is positioned between the second end of the central tube and the ignitor, (ii) an air ring assembly including a ring tube positioned above the second end of the flare stack central tube and substantially centered about the vertical axis of the flare stack central tube, wherein the ring tube has multiple fuel dispersing structures for distributing the waste fuel toward the vertical axis of the flare stack central tube between the second end of central flare stack member and the ignitor; and (iii) a turbulator assembly having a preheater loop positioned above the ring tube and a fuel distribution chamber with multiple nozzles for distributing the waste fuel towards the vertical axis of the central flare stack member between the second end of central flare stack member and the igniting means; and (d) a manifold having a waste fuel inlet end adapted for connection to a waste fuel source, wherein the manifold selectably connects the waste fuel source with one of the fuel paths, and an accelerator fuel inlet end adapted for connection to an accelerator fuel source, wherein the manifold selectably connects the accelerator fuel source with one of the fuel paths.

Still yet another aspect of the present invention is a method for burning waste fuel comprising: (1) connecting a waste fuel supply to a waste fuel inlet of a manifold; (2) connecting an accelerator fuel to an accelerator fuel inlet of the manifold; (3) connecting the manifold to a flare burner having multiple fuel paths; (4) connecting an air supply to a central flare stack member; (5) purging the central flare stack member with an air stream; (6) igniting a means for igniting a fuel stream exiting from a distal end of the flare burner; (7) connecting the waste fuel supply and the accelerator fuel supply to a selected common fuel path in the flare burner; (8) mixing the accelerator fuel and the waste fuel stream in the common fuel path; (9) mixing the accelerator/waste fuel mixture with the air stream; and (10) burning the mixture of the accelerator/waste fuel stream and the air stream until the waste fuel is substantially burned off.

The foregoing has outlined rather broadly several aspects of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 is viewed from the same angle as FIG. 2.

FIG. 4 is an oblique profile view of the open tip line of the flare stack.

FIG. 5 is an oblique profile view of the turbulator assembly of the flare stack.

DESCRIPTION OF THE PREFERRED EMBODIMENTS

The smokeless liquid two-phase burner system of the present invention relates to a method and apparatus for burning a wide variety of flammable liquids using an integrated burner system. The system has a multitude of fuel injection paths designed to optimize the burning of different flammable gases or liquids. For example, one embodiment has both a primary fuel injection path and an alternate fuel injection path for the gas or liquid fuel to be burned. The present invention also provides a multi-purpose manifold for selectably injecting a secondary stream of a gas or vapor or volatile liquid into a designated fuel injection path to enhance combustion. The burner system may optionally include main air pump or blower, a battery box for electrical power and a fuel tank, so that the system will be self-contained except for supplies of fuel for the burner.

Figure 1:
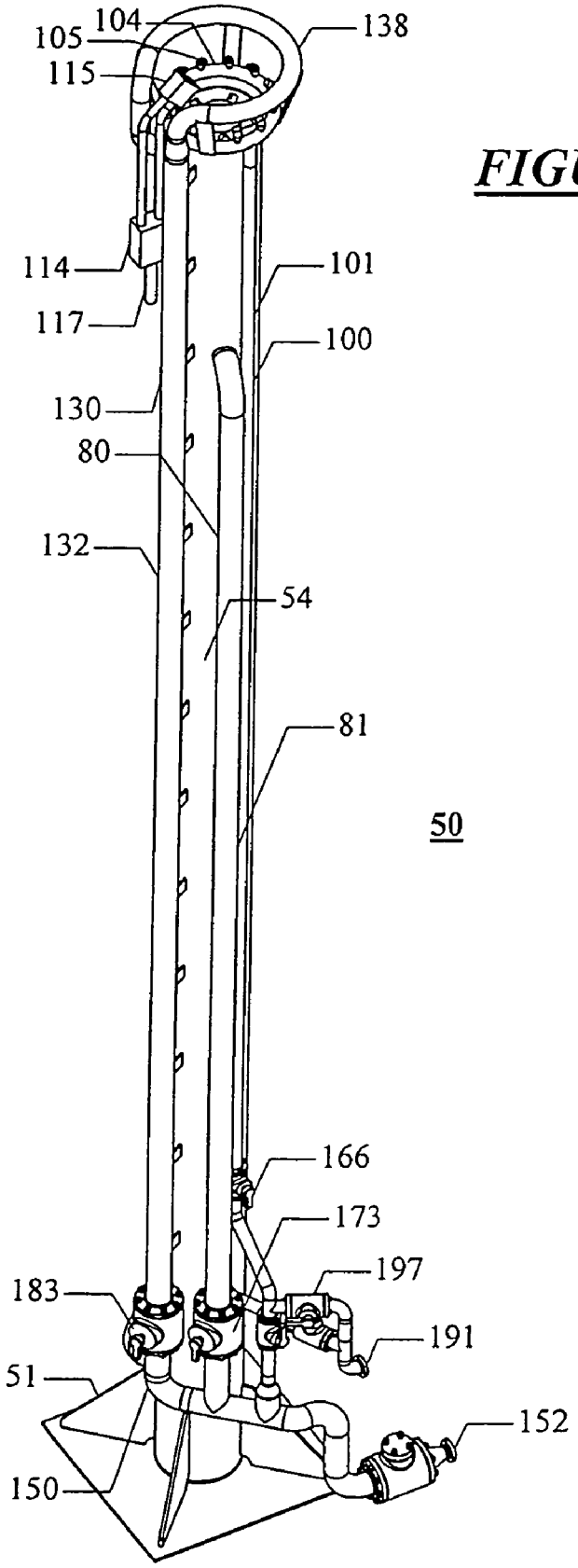
FIG. 1 is an oblique profile view of the flare stack of the present invention from a first side.
Figure 2:
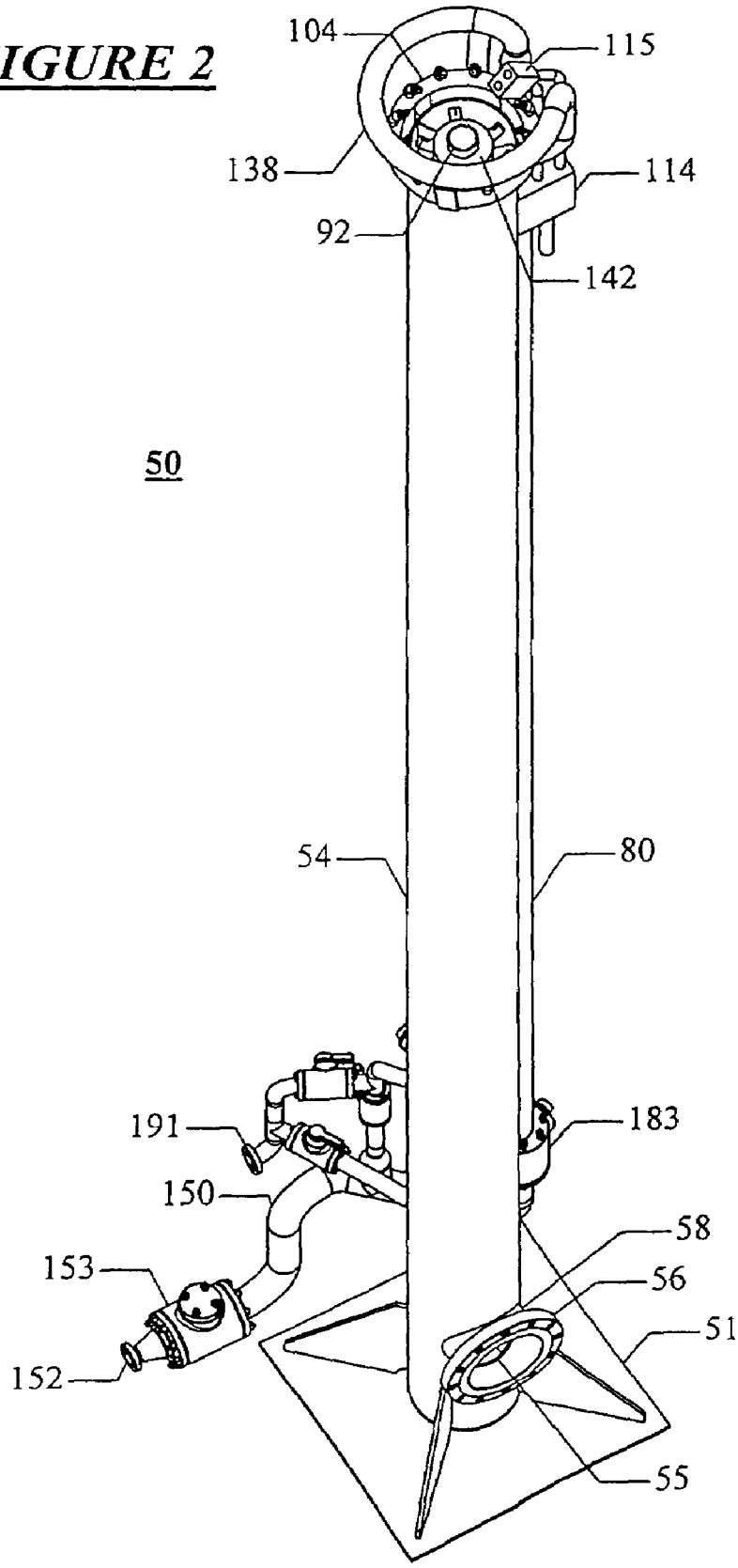
FIG. 2 is an oblique profile view of the flare stack of the present invention from a second side.

The materials of construction for the flare stack of the present invention are heat resistant metals such as 300 series stainless steels for the upper portions of the stack adjacent the burner head. The lower, cooler tubular portions of the flare stack and its base stand can be either carbon steel or the same heat resistant metals as are used in the upper portion of the stack. The piping, fittings, and valving of the manifold are normally carbon steel or high strength low alloy steel, with the valve seals and valving members typically stainless steel. The piping, the valves, and the flanges generally conform to American Petroleum Institute (API) or American National Standards Institute (ANSI) standards Referring to FIGS. 1, 2, and 3, the flare stack 50 of the present invention is seen to consist of a base stand 51, an elongated vertical flare stack main tube 54, multiple fuel injection paths such as an open tip line 80 and a turbulator assembly 130, an air ring assembly 100, an ignitor 114, and a multi-purpose manifold 150. Additional optional components for a self-contained burner system 10 of the present invention are shown with the flare stack 50 in FIG. 11.

The flare stack main tube 54, the open tip line 80, the air ring assembly 100, and the turbulator assembly 130 serve as supply lines for the primary fuel (waste fuel), air, and other vapors or liquids that enhance the combustion of the waste fuel (accelerator fuel) which are supplied to the burner system 10. With the exception of the high volume low pressure air supply, the manifold 150 serves as the primary distribution means for the supply of different fluids and gases or vapors to the burner system 10. Accelerator fuels include but are not limited to steam, butane, propane, methane and the like.

Figure 8:
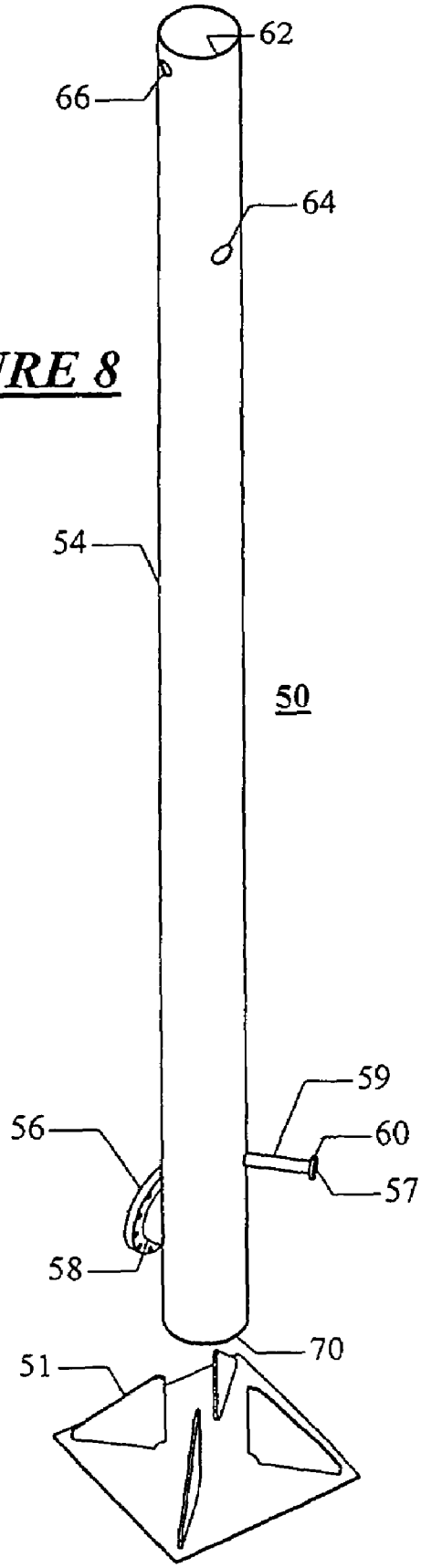
FIG. 8 is an oblique partially exploded view of the flare stack main tube and its base stand.

The flare stack main tube 54 is shown in FIG. 8, along with its mounting base stand 51. The base stand 51 consists of a flat horizontal rectangular plate with multiple vertical approximately triangular gusset plates positioned radially in a regular pattern about the vertical centerline axis of the horizontal plate. The diameter at which the inward vertical edges of the gusset plates are positioned corresponds to the outer diameter of the flare stack main tube 54. The gusset plates are welded to the horizontal base plate on their lower edges and to the flare stack main tube 54 on their vertical inward edges.

The flare stack main tube 54 is an elongated vertical constant diameter right circular cylindrical tube constructed of heat resistant alloy or stainless steel. As an example, the main tube 54 could have a diameter of 16 inches (406 mm), a wall thickness of 0.5 inch (12.7 mm), and a length of 30 feet (9.14 m). The main tube 54 is closed at its bottom end by the welded-on circular plate disk stack bottom cap 70.

At a short distance above the lower end of the vertical main tube 54 is a radially opening circular hole that serves as a main air port 55. Main air port 55 is surrounded by a welded-on concentric radially outwardly extending short pipe segment 58 integral with a transverse main air entry flange 56. The inner diameter of the flange 56 and the pipe segment 58 are the same as the diameter of the main air port 55. The main air port 55, the pipe segment 58, and the main air entry flange 56 can be seen best in FIG. 2.

At a small distance above main air port 55 and extending radially outwardly in a different direction is the high pressure auxiliary port 57. Auxiliary port 57 consists of an injection tube 59 having at its outward end a transverse auxiliary port flange 60 and at its inner end where it is welded to the main tube 54 a penetration into the interior of the main tube.

At approximately 80% to 85% of the height of main tube 54 is located a radially opening circular feed line entry hole 64 for the close accommodation of the horizontal leg 88 of the open tip line 80. The horizontal leg 88 of the open tip line 80 is welded into the hole 64 at assembly. The feed line entry hole 64 is not aligned with the main air port 55 and the auxiliary port 57.

Finally, a short distance below the top upwardly opening stack outlet 62 of the main tube 54 is a radially opening circular turbulator entry hole 66. The turbulator entry hole 66 is a close fit to the side entry tube 141 of the turbulator assembly 130 and is not aligned with the other penetration holes 55, 57, and 64 in the main tube 54. The side entry tube 141 of the turbulator assembly 130 is welded into the turbulator entry hole at assembly.

The open tip line 80 of the flare stack 50 is shown in detail in FIG. 4. In sequential order from its lower end, the open tip line 80 consists of an inlet flange 82, an elongated vertical external tube 81, a 90° elbow 86, a short horizontal leg 88, another 90° elbow 86, and a vertical tubular upper line 90. The inlet 84 for the open tip line 80 is through the flange 82 and the lower end of the external tube 81, while the open tip outlet 92 is the upper end of the upper line 90. The two elbows 86 and the short horizontal leg 88 provide a transverse offset between the external tube 81 and the upper line 90 so that the open tip line 80 can be passed through the feed line entry hole 64 of the flare stack main tube 54.

The external tube 81 of the open tip line 80 is attached to the exterior of the flare stack main tube 54 of the flare stack 50 by a vertical array of vertical rectangular plate mounting tabs 94. The mounting tabs 94 are attached radially to the flare stack main tube 54 and the external line 81 by welding. The upper line 90 is located on the vertical axis of the flare stack main tube 54. The upper line is made of heat resistant material, since it is exposed to very high temperatures when the burner system 10 is operational. The open tip line 80 has a constant outer diameter and for a typical case would be 4.5 inch (114.3 mm) pipe. When installed in the main tube 54 of the flare stack 50, the open tip outlet 92 of the open tip line 80 is positioned slightly above the upper stack outlet 62 of the main tube. For example, the open tip outlet 92 might be installed 2 inches (50.8 mm) above the stack outlet 62 of the flare stack 50.

Figure 7:
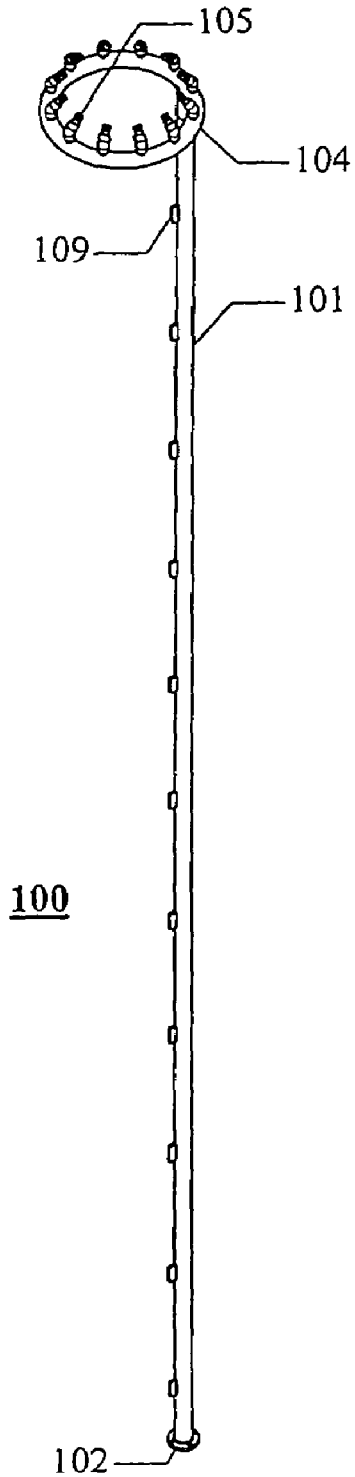
FIG. 7 is an oblique view of the air ring assembly of the flare stack.

The air ring assembly 100 is shown in FIG. 7. The air ring assembly 100 consists of a vertical main tube 101 having a transverse inlet flange 102 at its lower end that serves as an inlet and a horizontal transverse toroidal ring tube 104 that is attached by welding at its upper end. The centerline of the vertical main tube 101 intersects the median diameter of the ring tube 104 and the bores of the ring tube 104 and the main tube 101 are connected. By way of example, the outer diameter of the main tube 101 and the ring tube 104 of the air ring assembly 100 might be 2.375 inch (60.3 mm), while the diameter of the torus of the ring tube might be 20.5 inch (521 mm).

The ring tube 104 has an array of regularly spaced upwardly opening circular holes with their axes coincident with the median diameter of the ring tube 104. Concentric with each of these holes is a welded-on short pipe nipple 106 that has a threaded upper end. A threaded female 45° elbow 107 is screwed onto each nipple so that both axes of its threaded outlets lie in a radial plane of the ring tube 104. An injector 108 consisting of a right circular cylindrical rod, having a relatively small diameter axial through hole, a male threaded first end, and a dispersal notch located adjacent the second end, is sealingly threadedly engaged in the other port of the elbow 107. The diameter of the axial hole in the injector 108 typically lies in the range of 0.125 inch (3.2 mm) to 0.375 inch (9.5 mm). The dispersal notch of each injector 108 is cut from one side of the injector to intersect the axial hole and is oriented so that it is on the upward side of the mounted injector. A first side of the dispersal notch is transverse to the axis of the injector 108, a second side is vertical, and a third side is parallel to but offset from the axis of the injector.

The main tube 101 is provided with a vertically extending regularly spaced array of rectangular plate main tube mounting tabs 109 attached to the main tube 101 by welding and lying in a radial plane of the vertical axis of symmetry of the ring tube 104. These mounting tabs 109 are used to affix the air ring assembly 100 to the outside of the flare stack main tube 54 so that the tabs lie in a radial plane of the main tube of the flare stack 50 and the axis of the ring tube is concentric with the vertical axis of the main tube. The ring tube 104 of the installed air ring assembly 100 is spaced above the stack outlet 62 of the flare stack main tube 54. By way of example, the horizontal midplane of the ring tube 104 might be located 2 inches (50.8 mm) above the stack outlet 62.

Figure 6:
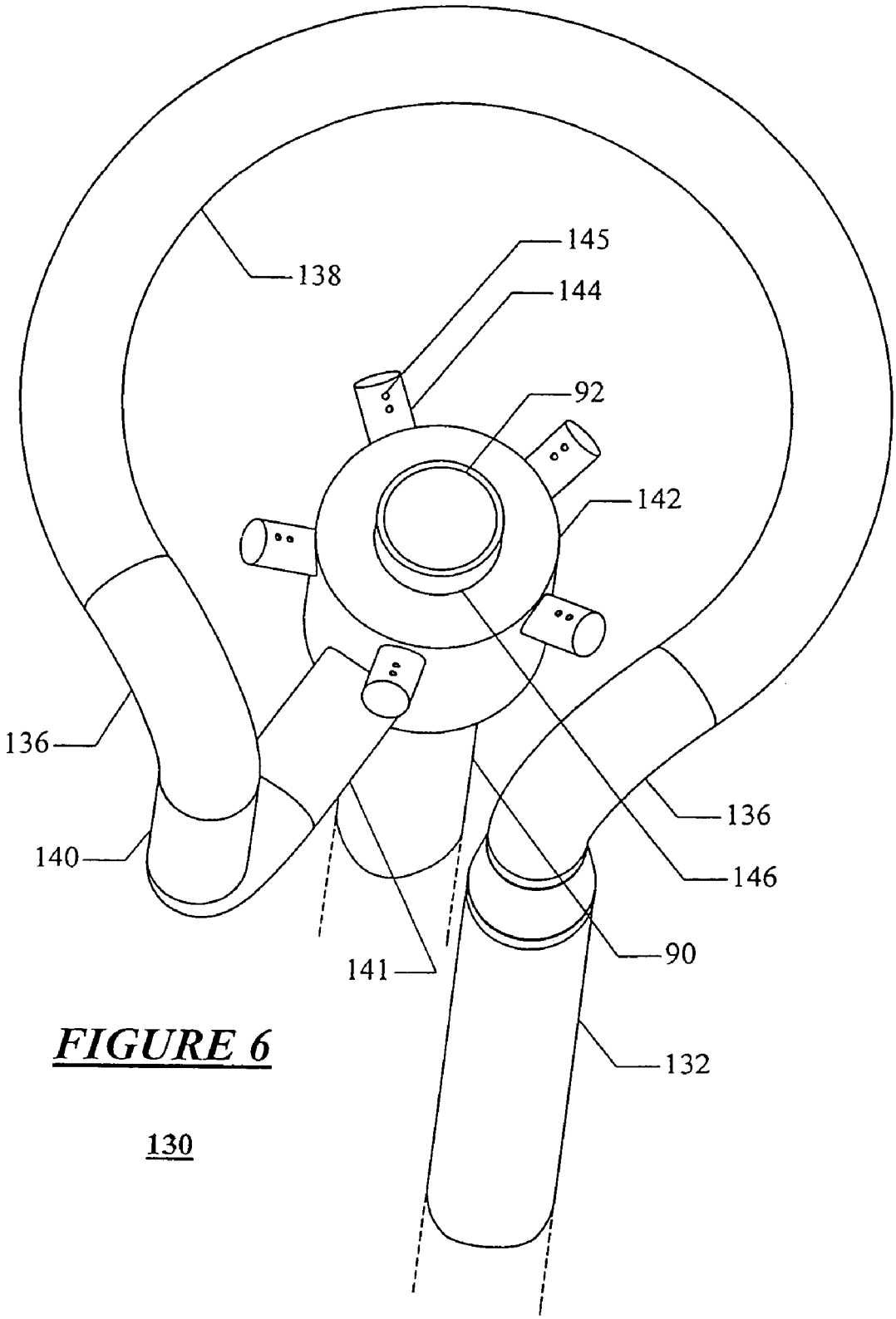
FIG. 6 is an oblique view showing details of the upper end of the turbulator assembly of FIG. 5.

A turbulator assembly 130, shown in FIGS. 5 and 6, is provided to preheat and better disperse fuel than would be the case if the fuel were delivered through the open tip line 80 of the flare stack 50. Welding joins the components of the turbulator assembly 130, and the entire upper portion of the turbulator is made of heat resistant alloy or stainless steel. The turbulator assembly 130 consists of a vertical main tube 132 having a transverse inlet flange 133 and an inlet port 134 at its lower end. The main tube 132 is provided with a pipe reducer fitting and a 90° elbow fitting 136 at its upper end.

The outlet of the elbow 136 joined to the main tube 132 and the reducer extends horizontally and is connected to the first end of the partial toroidal preheater loop 138. The preheater loop 138 has a constant diameter and is located above the stack outlet 62 and the ring tube 104. For example, one embodiment of the preheater loop 138 has a diameter of about 27 inches (177.8 mm), an arc length of approximately 300°, and is located about 12 inches (304.8 mm) above the stack outlet 62. The preheater loop 138 is connected at its second end to another 90° elbow 136, which is in turn connected to a short vertical tubular downward leg 140.

At the lower end of the downward leg 140, another 90° elbow 136 connects to short side entry tube 141. The side entry tube is radially positioned relative to the distributor chamber 142 and has an entry port into the distributor chamber so that the distributor chamber can be supplied with fuel by the fluid conduit composed of the main tube 132, the pipe reducer, the elbows 136, the preheater loop 138, the downward leg 140, and the side entry tube 141. The side entry tube 141 is a close fit to the turbulator entry hole 66 of the main tube 54 of the flare stack 50 and is welded into that hole.

One embodiment of the main tube 132 has a diameter of about 4.5 inches (114.3 mm), and the length of the main tube is approximately 80% of the length of the main tube 54 of the flare stack 50. Also by way of example, the tubular components of the turbulator assembly 130, other than the main tube 132 and the pipe reducer, can have an outer diameter of about 2.375 inches (60.3 mm). Further, the upper end of the distributor chamber 142 is positioned just below the top of the main tube 54 of the flare stack 50, as for example 2 (50.8 mm) inches below the top of the main tube 54.

The distributor chamber 142 is typically a right circular cylindrical tube having annular plate rings for its upper and lower ends. The vertical axis of symmetry of the distributor chamber 142 is coincident with the vertical axis of the preheater loop 138 and the vertical centerline axis of the main tube 54 of the flare stack 50. Generally, the length and outer diameter of the distributor chamber are selected to be approximately the same, and the central passage holes 146 through the upper and lower ends are a close fit to the outer diameter of the upper line 90 of the open tip line 80. The upper line 90 of the open tip line is sealingly welded into the central passage holes 146 of the distributor chamber 142.

The upper cylindrical end of the distributor chamber 142 is provided with multiple circumferentially equispaced circular holes which are upwardly inclined at their outer ends from the vertical central axis of the distributor chamber. An injector 144 is welded to the outer diameter of the distributor chamber coaxially with each of the inclined axis holes. The injector 144 consists of a short tube stub coped on a first end to fit to the outer diameter of the distributor chamber 142 with a transverse outer second end closed with a welded cap plate.

Each injector 144 has one or more radial holes which have their axes intersecting the vertical centerline axis of the main tube 54 of the flare stack 50, and which serve as injector nozzles 145. Thus, the array of injector nozzles on the injectors direct any liquid or gas injected through the turbulator assembly inwardly and upwardly towards the vertical centerline axis of the flare stack 50.

A vertical array of regularly spaced rectangular plate mounting tabs 147 positioned in a radial plane of the main tube 54 of the flare stack 50 are welded in to serve to connect the main tube 132 of the turbulator assembly 130 to the main tube of the flare stack.

Figure 3:
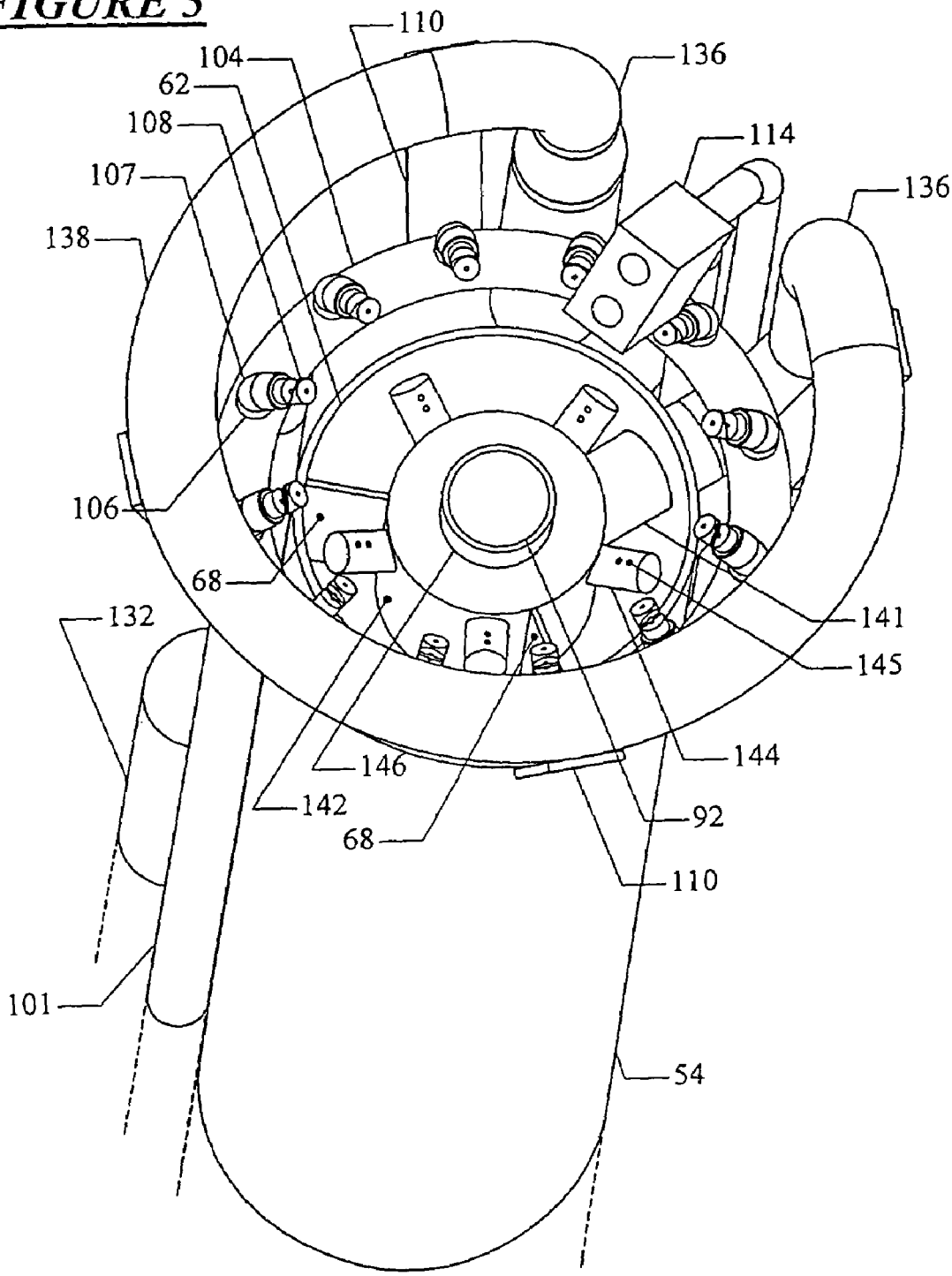
FIG. 3 is an oblique view of the upper end of the flare stack showing the details of the interrelationships of the constituent components of the burner.

The geometric interrelationships of the upper ends of the main tube 54 of the flare stack, the open tip line 80, the air ring assembly 100, and the turbulator assembly 130 is illustrated in FIG. 3. Two welded-in rectangular plate turbulator chamber mounting tabs 68 extend radially between the outer cylindrical surface of the distributor chamber 142 and the interior of the flare stack main tube 54 to stiffen the attachment of the upper end of the turbulator assembly to the flare stack 50. Multiple rectangular plate ring mounting tabs 110 are each lapped and welded onto the ring tube 104 of the air ring assembly 100 on a first end and onto the preheater loop 138 of the turbulator assembly 130 at a second end in order to rigidly mount the ring tube to the flare stack 50.

A commercially available ignitor 114 with its attached combined pilot fuel line and power cable 117 is attached to the upper end of the main tube 54 of the flare stack 50. The ignitor 114 has a tip 115 which extends in the arcuate gap of the preheater loop 138 so that it is inboard of and above the ring tube 104 and its nozzles 105.

Figure 9:
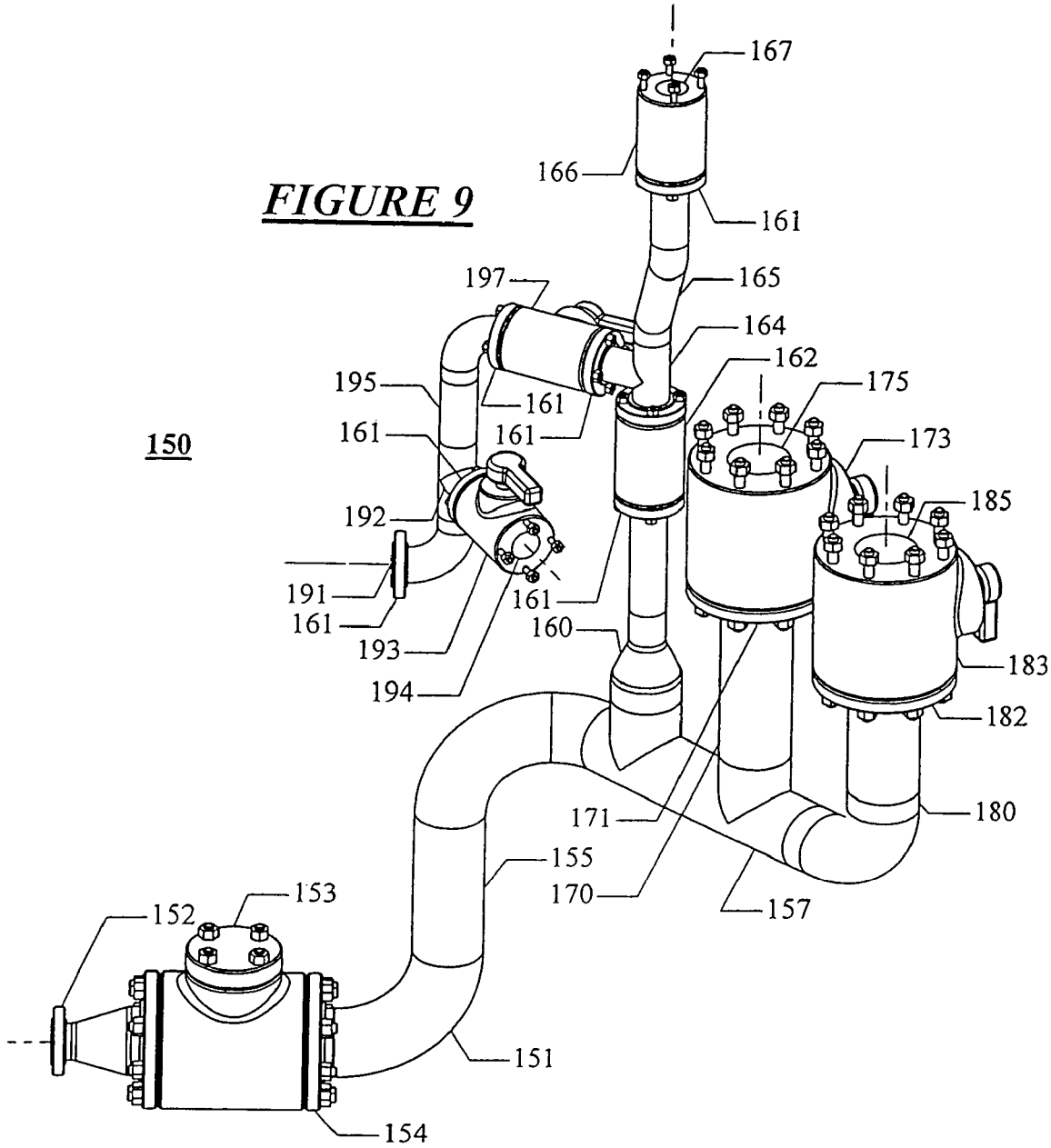
FIG. 9 is an oblique view of the manifold used to direct fluid flow to the different flow channels of the flare stack.
Figure 10:
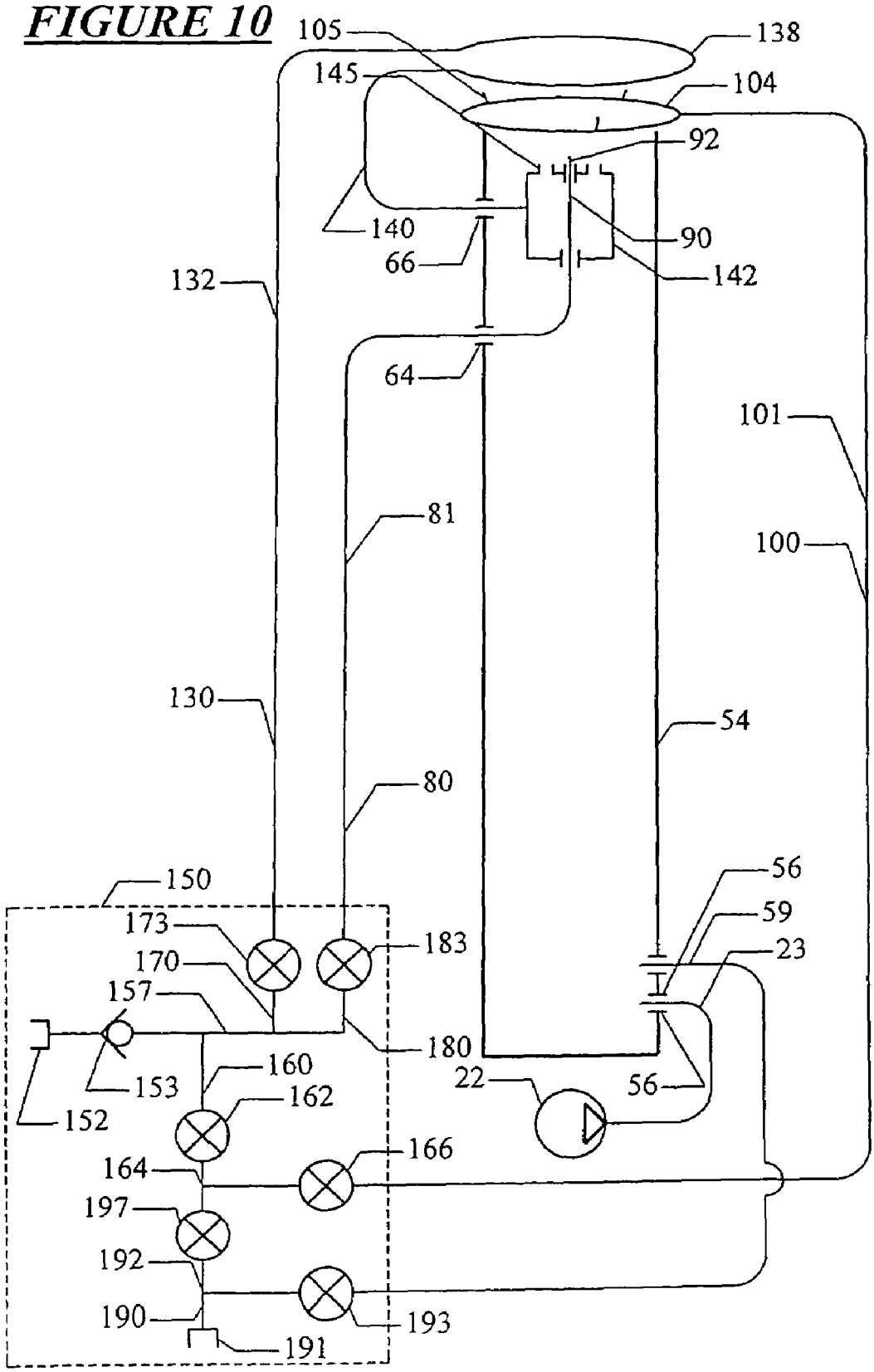
FIG. 10 is a circuit diagram for the flow system of the flare stack of the present invention.

The manifold 150 of the flare stack 50 is shown in an oblique view in FIG. 9 and indicated as a portion of the schematic view of the flow system of the flare stack in FIG. 10. As shown herein, the manifold 150 is supported by the connection of its flanges to the flanges on the inlet ends of the lines on the flare stack 50, but as may be understood readily, other supports could be utilized without departing from the spirit of the present invention.

The multi-purpose manifold 150 has a number of valves 162, 166, 173, 183, 193, and 197 that allow the operator of flare stack 50 to direct the flow of gas or fluids through one or more fluid paths. Although ball valves are illustrated in FIG. 9, other types of valves would also be useable. Ball valves are suitable for the operational pressures to be expected for the flare stack 50, but are used only for on/off duty. In the event that metering, as well as on/off service, is required for the manifold 150, gate valves can be substituted for the ball valves shown.

The manifold 150 has two inlets and four outlets. The main inlet line 151 consists of a horizontal entry fitting 152, a check valve 153, a flange connection 154 to the check valve, a first tubular line segment 155, and a horizontal tubular line header 157. The entry fitting 152 in FIG. 9 is a doubly flanged reducer fitting with the larger flange attached to the check valve 153, but the entry end could be varied to accommodate other types of connection. Starting from the connection with the check valve 153, the first line segment consists of a 90° elbow on which flange 154 is mounted, a short vertical pipe section 155, another 90° elbow, and a 45° elbow.

The header 157 is a horizontal tubular section having three outlets to the first branch line 160, the second branch line 170, and the third branch line 180. The first and second outlets are upwardly extending tee connections, while the third outlet is an upwardly extending 90° elbow, with all connections having the same size as the header 157.

Starting from its bottom end at its connection to the first outlet of the header 157, the first branch line 160 has a reducer fitting reducing the line size, a short pipe section, a first transverse flange 161, a first valve 162, a second transverse flange 161, a first branch line tee connection 164 branching off horizontally and having a distal third transverse flange 161, an upwardly extending first branch line extension 165, a fourth transverse flange 161, and a vertically oriented second valve 166. The first branch line extension 165 consists of, from its lower end where it adjoins tee 164, a 45° elbow, a short section of straight pipe, a second 45° elbow, and a final short vertical section of pipe. The outlet 167 of the second valve 166 serves as a feed line for connection to the flange 102 of the air ring assembly 100.

The second branch line 170 of the manifold 150 has, from its lower end, a short section of vertical pipe with a transverse second branch line flange 171, and a vertically oriented third (for the manifold) valve 173. The upwardly opening outlet 175 of third valve 173 serves as a connection point for the attachment of the flange 133 of the turbulator assembly 130.

The third branch line 180 of the manifold 150 has, from its lower end where it connects to the 90° elbow of the header 157, a straight vertical pipe section, a transverse flange 182, and a vertical fourth (for the manifold) valve 183. The upwardly opening outlet 185 of the fourth valve 183 serves as a connection port to attach to the flange 82 of the open tip line 80 of the flare stack 50.

Manifold 150 has a secondary flow branch 190. The inlet of secondary flow branch 190 is at the horizontally opening entry flange 191. Sequentially from the entry flange 191, the secondary flow branch is also constituted by a 90° elbow, a horizontally branching tee fitting 192 mounting a transverse flange 161 and a horizontal fifth (for the manifold 150) valve 193, a short vertical pipe section 195 extending upwardly from the tee 192, another 90° elbow, a secondary flow branch outlet transverse flange 161, and a sixth valve 197. The fifth valve 193 has a horizontal outlet opening 194 that serves as a connection to the auxiliary port flange 60 of the flare stack main tube 54. The sixth valve 197 connects to the horizontally opening flange 161 on the horizontal branch of the tee fitting 164 of the first branch line 160 of the manifold 150.

Figure 11:
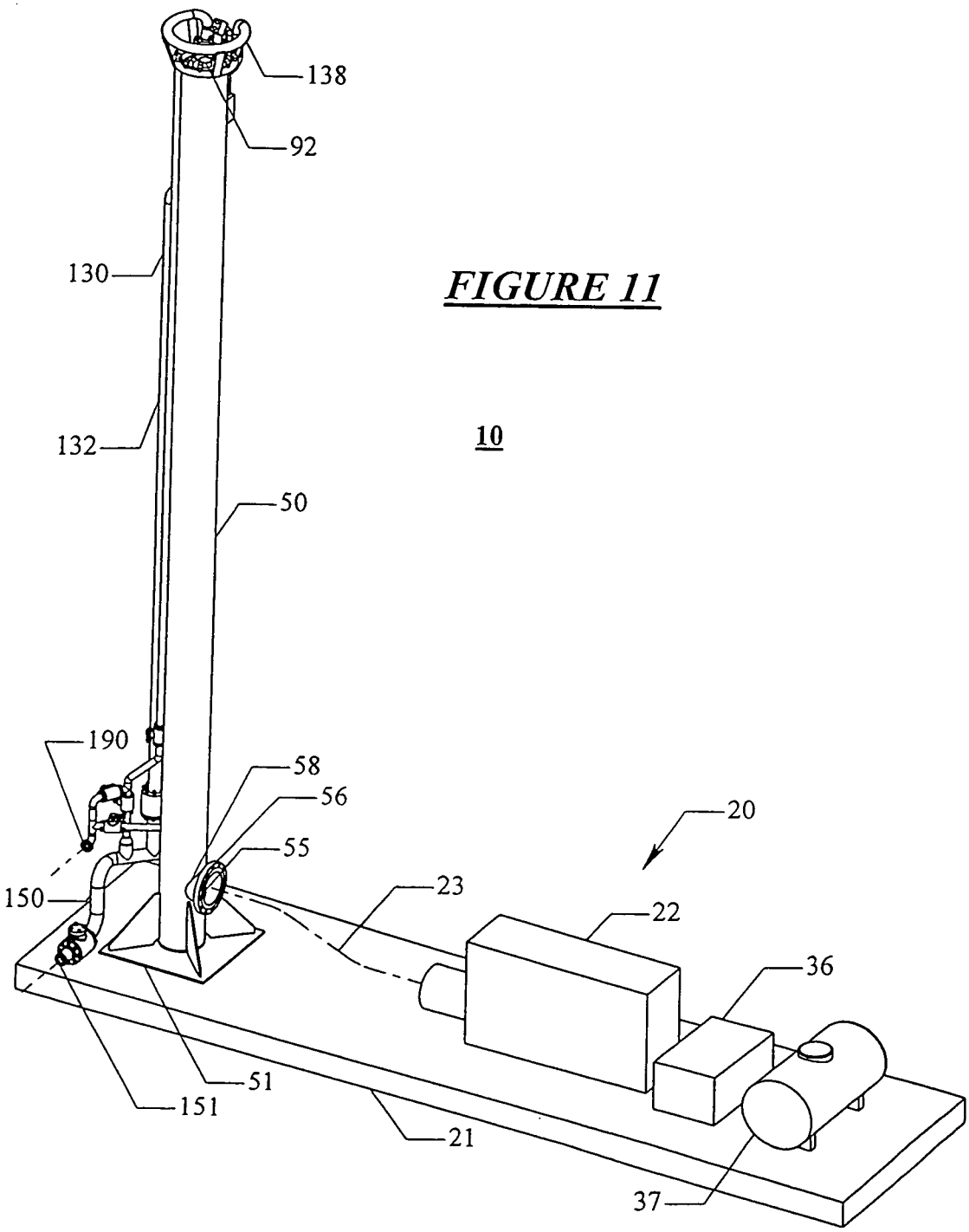
FIG. 11 is an oblique view of the flare system of the present invention, including the flare stack and its support hardware, wherein the burner system is shown mounted on a mounting base.

Referring to FIG. 11, the arrangement of the support hardware 20 for the flare system 10 is shown. The flare system 10 requires a very high volume of low pressure air to be delivered to the flare stack 50 through the main air port 55. Main air pump blower 22 with its integral drive diesel engine compresses and delivers this air through a large diameter flexible conduit main air delivery tube 23 (not shown, but routing indicated). The main air delivery tube is connected at its first end to the blower 22 and at its other end to the main air entry flange 56 of the main tube 54 of the flare stack 50. The flare system 10 also requires a large set of DC storage batteries, stored in an explosion-proof or alternatively a purged battery box 36. The batteries in the battery box 36 serve to operate the starter for drive diesel engine for the main air pump blower 22, as well as providing operating power to the ignitor 114 on the flare stack 50. A fuel tank 37 supplies fuel for the drive diesel engine of the main air pump blower 22.

The support hardware 20 and the flare stack 50 are mounted on a rectangular horizontal mounting base 21. The main air pump blower 22, the battery box 36, and the fuel tank 37 are positioned in sequence moving away from the flare stack 50 on the mounting base 21 on the axis of the main air port 55 of the main tube 54 of the flare stack. The electrical and fuel line connections for the support hardware 20 are not shown for clarity. The entry fitting 152 of the main inlet line 151 and the entry flange 191 of the secondary flow branch 190 of the manifold 150 are both readily accessible at the side of the mounting base 21.

OPERATION OF THE INVENTION

In the event that a readily burnable material such as methane is to be flared using the flare system 10 of the present invention, the operation of the system is straightforward, as will be described in the following material. However, for flaring more difficult fuels, there are four ways typically used to enhance the ability of a flare system to burn a liquid or gas material. For these four methods of enhancing combustion, the fuel is sprayed from the turbulator assembly 130.

One way to enhance combustion is to use steam pumped into the fuel at the burner in order to enhance vaporization by raising the fuel temperature and, through expansion of the steam, separating the sprayed fuel into smaller particles with more surface area. A second way to enhance combustion is to inject air into the fuel stream in order to aerate the stream and thereby make it easier to burn by separating the sprayed fuel into smaller particles with more surface area. A third way involves injecting a more readily burnable gas into a less flammable fuel stream, while a fourth way involves preheating the fuel stream by means of a heat exchanger in order to decrease its viscosity and make it easier to vaporize the sprayed fuel.

For fuels that are more difficult to burn, the ability to burn them is enhanced by increasing their fluidity using one of the methods described above so that they are more easily atomized. Further, when it is required, admixture of the fuel supply with a separately supplied stream of more readily burned material (accelerator fuel) improves the ignition and burning of the primary fuel for the flare system. The use of forced draft air to increase the supply of oxygen to the flame also markedly improves combustion efficiency.

When the flare system is to be operated, the set up of the system proceeds as follows. The supply (not shown) of the primary or waste fuel to be burned is attached to the entry fitting 152 of the main inlet line 151. The secondary supply line (not shown) to the secondary or accelerator fuel is attached to the entry flange 191 of the secondary flow branch 190 of the manifold 150. The check valve 153 prevents backflow into the fuel supply line. The main air delivery tube 23 is attached to both the main air pump blower 22 and the main air entry flange 56 on the main tube 54 of the flare stack 50. The interior of the main tube 54 of the flare stack 50 is then purged with air provided by the blower 22 and then the blower is stopped.

For the case when only a readily burned fuel such as methane is to be burned, the process does not require a secondary supply to achieve full combustion. Accordingly, to initiate burning, the ignitor 114 is lit by turning on its fuel supply (typically butane or propane, but not shown herein) and its power. The waste fuel supply is then turned on and, with only the fourth valve 183 open, the waste fuel is fed to the top of the flare stack 50 through the open tip line 80 where it is ignited by the ignitor 114. If desired, the blower 22 can be turned on to supply air up the interior of the main tube 54 of the flare stack to further enhance combustion.

For the burning of a less readily combustible fuel, a secondary supply or an accelerator fuel is necessary to achieve full combustion. The air blower 22 is started at a low flow rate of approximately 40% of its full flow rate of 7000 cubic feet per minute to feed low pressure high volume air flow up the interior of the main tube 54 of the flare stack 50. Then, the waste fuel is fed through the main inlet line 151 and only the third valve 173 in the manifold 150 is opened slowly. The waste fuel is fed into the turbulator assembly 130 until it emerges by spraying in multiple diffuse streams from the injector nozzles 145. The ignitor 114 then ignites the waste fuel.

As the fuel supply is increased, the speed of the blower 22 is correspondingly increased. The diffuse spray from the injector nozzles 145 of the turbulator 130 are readily ignited by the ignitor 114 and, since they have a large surface area and are provided with additional oxygen from the blower 22, a very turbulent flame pattern is produced. The flame turbulence further ensures good mixing of the fuel with the surrounding air stream. The intense heat from the flame heats the incoming flow of the fuel through the preheater loop 138 of the turbulator assembly 130 by radiation; thereby further aiding in its atomization by the injector nozzles 145.

If it is desired to inject steam or another secondary gas or volatile liquid stream to further enhance combustion of the fuel, it may be done in three ways. The secondary stream is injected into the manifold 150 by way of the entry flange 191 of the secondary flow branch 190. For the first injection method when the secondary stream is to be flowed up the main tube 54 of the flare stack 50, as would be practical for steam but not for combustible flows, sixth valve 197 is left closed and fifth valve 193 is opened. The secondary flow then enters the main tube 54 through the auxiliary port 57 and flows upwardly to the burner.

Both the second and third secondary stream injection methods close the fifth valve 193 and open the sixth valve 197. For the second method, the second valve 166 is opened with the first valve 162 closed, so that the secondary flow is directed up the air ring assembly 100 to emerge into the flame zone through the air nozzles 105. For the third method, the second valve 166 is closed and the first valve 162 opened, so that the secondary flow stream is merged with the fuel flowing through the header 157 and the mixed flow stream is sprayed from the injector nozzles 145 of the turbulator assembly 130.

The second and third methods of directing the secondary flow through the manifold 150 and into the combustion zone aid combustion by increasing fuel volatility and turbulence, thereby aiding the necessary vaporization of the fuel to permit its combustion. Generally, heavier waste fuels will require that steam, methane, propane, or butane be injected through the secondary flow branch 190 and into the burner at the upper end of the flare stack 50 by either the second or third methods of directing the secondary flow.

In the event that a pipeline is being purged, the fuel is supplied from the pipeline, with the pipeline being purged by a charge of nitrogen gas. As this purge nitrogen is mingled with the fuel, the heating value of the fuel stream to the flare stack 50 is reduced. Since it is still desirable to combust the diluted fuel, the secondary flow branch 190 is utilized to add a more combustible supply such as butane or propane to the main fuel using the comingling of the flow streams of the third method described above. Instrumental monitoring of the incoming flow stream to the burner or the combustion gases is used to indicate completion of the pipeline purging process.

When a flaring operation is complete, the waste fuel supply and the secondary accelerator fuel supply, if any, are turned off and, if necessary, disconnected, while all of the valves of the manifold 150 are closed. It may be necessary for the fuel inlet valve from the supply line to thaw, since it can freeze due to cooling resulting from throttling action when gas is expanded in that valve. The air blower 22 is then stopped after the stack tip is sufficiently cool.

ADVANTAGES OF THE INVENTION

The combination of the multiple means of enhancing combustion of a waste fuel stream being burned in a flare system 10 permits using the flare system for a wide spectrum of fuels. Light, volatile fuels such as methane can be burned readily by the flare stack 50 by using its open tip line 80 either with or without supplemental air flow from the blower 22.

Less volatile fuels such as propylene or butane can be burned by preheating the fuel stream using the preheater loop 138 of the turbulator assembly 130 to increase the volatility of the incoming fuel stream. The diffuse sprays of fuel emitted by the injector nozzles 145 of the turbulator assembly 130 strongly aid the atomization and burning of the fuel. The ability to heat the flow stream and increase its turbulence when sprayed can be aided significantly by direct injection of steam into the primary fuel flow or indirect injection of steam either up the main tube 54 of the flare stack 50 or through the air ring assembly 100. Likewise, the provision of a secondary stream of more combustible gas or liquid to the burner aids combustion of the primary fuel by providing additional heat for volatilization and more turbulence with attendant mixing to the flame. The ability to either mix the secondary or accelerator fuel directly with the waste fuel flow stream or to deliver it separately to the burner provides versatility for handling a broader variety of fuel types. This compatibility of the flare system 10 with a wide variety of fuels eliminates the need for a separate type of flare stack for each type of fuel.

It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

What is claimed is:

1. A flare system for burning waste fuel comprising:

(a) a central flare stack member adapted for connection with an air supply at a first end;

(b) a plurality of fuel paths for conducting a waste fuel to an outlet at a second end of the central flare stack member, wherein the fuel paths include an air ring assembly including a ring tube substantially centered above the second end of the central flare stack member and below an ignitor, the ring tube having multiple fuel dispersing structures positioned to disperse the waste fuel toward the vertical axis of the central flare stack member;

(c) the ignitor positioned proximal the second end of the central flare stack member; and (d) a manifold having a waste fuel inlet end adapted for connection to a waste fuel source, wherein the manifold selectably connects the waste fuel source with one of the fuel paths, and an accelerator fuel inlet end adapted for connection to an accelerator fuel source, wherein the manifold selectably connects the accelerator fuel source to one of the fuel paths.

2. The flare system of claim 1, wherein one fuel path has a turbulator assembly positioned proximal the second end of the central flare stack member, the turbulator assembly including a preheater and a distribution chamber with multiple injectors for injecting the waste fuel toward the vertical axis of the central flare stack member between the second end of central flare stack member and the ignitor.

3. The flare system of claim 2, wherein the manifold selectably distributes a mixture of the waste fuel and the accelerator fuel to the turbulator assembly.

4. The flare system of claim 1, wherein the accelerator fuel is more combustible than the waste fuel.

5. The flare system of claim 1, wherein the air supply is an air blower.

6. The flare system of claim 1, wherein the fuel paths include an open tip fuel supply line providing the waste fuel between the second end of central flare stack member and the igniting means.

7. The flare system of claim 1, wherein the manifold has multiple valving members for selectably conducting the waste fuel into a desired fuel path, the desired fuel path selected to admix the waste fuel with the air supply and for selectably adding a quantity of the accelerator fuel to the fuel path to assist combustion.

8. The flare system of claim 7, wherein a valving member regulates the waste fuel being selectably conducted into the desired fuel path.

9. The flare system of claim 7, wherein a valving member regulates the accelerator fuel being selectably conducted into the desired fuel path.

10. A flare system for burning waste fuel comprising:

(a) a central flare stack member adapted for connection with an air supply at a first end;

(b) means for igniting a waste fuel positioned proximal a second end of the central flare stack member;

(c) a plurality of fuel paths for conducting the waste fuel to an outlet at the second end of the central flare stack member, wherein the fuel paths include (i) an open tip fuel supply line providing the waste fuel between the second end of central flare stack member and the igniting means, (ii) an air ring assembly including a ring tube substantially centered above the second end of the central flare stack member with multiple fuel dispersing structures positioned to disperse the waste fuel toward the vertical axis of the central flare stack member, and (iii) a turbulator assembly having a preheater loop positioned above the ring tube and a fuel distribution chamber with multiple nozzles for distributing the waste fuel toward the vertical axis of the central flare stack member between the second end of central flare stack member and the igniting means; and (d) a manifold having a waste fuel inlet end adapted for connection to a waste fuel source, wherein the manifold selectably connects the waste fuel source with one of the fuel paths, and an accelerator fuel inlet end adapted for connection to an accelerator fuel source, wherein the manifold selectably connects the accelerator fuel source to one of the fuel paths.

11. A flare system for burning waste fuel comprising:

(a) a vertical tubular flare stack member adapted for connection with an air supply at a first end;

(b) means for igniting a waste fuel positioned proximal a second end of the central flare stack member;

(c) a manifold having (i) multiple valving members, (ii) a waste fuel inlet end adapted for connection to a waste fuel source, wherein selected manifold valving members selectably connect the waste fuel source with one of a plurality of fuel paths, and (iii) an accelerator fuel inlet end adapted for connection to an accelerator fuel source, wherein selected manifold valving members selectably connect the accelerator fuel source to one of the fuel paths; and (d) the plurality of fuel paths for conducting the waste fuel between a second end of the flare stack member and the igniting means, wherein the fuel paths include an air ring assembly including a ring tube substantially centered above the second end of the central flare stack member and below the igniting means, the ring tube having multiple fuel dispersing structures positioned to disperse the waste fuel toward the vertical axis of the central flare stack member.

12. The flare system of claim 11, wherein one fuel path has a turbulator assembly positioned proximal the second end of the central flare stack member, the turbulator assembly including a preheater and a distribution chamber with multiple injectors for injecting the waste fuel toward the vertical axis of the central flare stack member between the second end of central flare stack member and the igniting means.

13. The flare system of claim 12, wherein the manifold selectably distributes a mixture of the waste fuel and the accelerator fuel to the turbulator assembly.

14. The flare system of claim 11, wherein the accelerator fuel is more combustible than the waste fuel.

15. The flare system of claim 11, wherein the fuel paths include an open tip fuel supply line providing the waste fuel between the second end of central flare stack member and the igniting means.

16. A flare system for burning waste fuel comprising:

(a) a vertical tubular flare stack member adapted for connection with an air supply at a first end;

(b) means for igniting a waste fuel positioned proximal a second end of the central flare stack member;

(c) a manifold having (i) multiple valving members, (ii) a waste fuel inlet end adapted for connection to a waste fuel source, wherein selected manifold valving members selectably connect the waste fuel source with one of a plurality fuel paths, and (iii) an accelerator fuel inlet end adapted for connection to an accelerator fuel source, wherein selected manifold valving members selectably connect the accelerator fuel source to one of the fuel paths; and (d) the plurality of fuel paths for conducting the waste fuel between a second end of the flare stack member and the igniting means, wherein the fuel paths include an open tip fuel supply line providing the waste fuel to a point between the second end of central flare stack member and the igniting means; an air ring assembly including a ring tube substantially centered above the second end of the central flare stack member with multiple fuel dispersing structures positioned to disperse the waste fuel toward the vertical axis of the central flare stack member; and a turbulator assembly having a preheater loop positioned above the ring tube and a fuel distribution chamber with multiple nozzles for distributing the waste fuel toward the vertical axis of the central flare stack member between the second end of central flare stack member and the igniting means.

17. A flare burner for burning waste fuel comprising:

(a) an elongated vertical flare stack central tube having a main air port proximal to a first end of the flare stack and an auxiliary port;

(b) an ignitor positioned above a second end of the flare stack central tube;

(c) a plurality of fuel paths for conducting a waste fuel proximal the second end of the central tube, the fuel paths including (i) an open tip fuel supply line, wherein an upper portion of the open tip fuel supply line is coaxial with the vertical axis of the flare stack central tube and an outlet of the open tip fuel supply line is positioned between the second end of the central tube and the ignitor, (ii) an air ring assembly including a ring tube positioned above the second end of the flare stack central tube and substantially centered about the vertical axis of the flare stack central tube, wherein the ring tube has multiple fuel dispersing structures for distributing the waste fuel toward the vertical axis of the flare stack central tube between the second end of central flare stack member and the ignitor; and (iii) a turbulator assembly having a preheater loop positioned above the ring tube and a fuel distribution chamber with multiple nozzles for distributing the waste fuel towards the vertical axis of the central flare stack member between the second end of central flare stack member and the igniting means; and (d) a manifold having a waste fuel inlet end adapted for connection to a waste fuel source, wherein the manifold selectably connects the waste fuel source with one of the fuel paths, and an accelerator fuel inlet end adapted for connection to an accelerator fuel source, wherein the manifold selectably connects the accelerator fuel source with one of the fuel paths.

* * * * *